US009657252B2

(12) United States Patent
Bennett et al.

(10) Patent No.: US 9,657,252 B2
(45) Date of Patent: May 23, 2017

(54) LUBRICANT ADDITIVES AND LUBRICANT COMPOSITIONS HAVING IMPROVED FRICTIONAL CHARACTERISTICS

(71) Applicant: Afton Chemical Corporation, Richmond, VA (US)

(72) Inventors: Carl W. Bennett, Glen Allen, VA (US); Mark T. Devlin, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 121 days.

(21) Appl. No.: 14/255,465

(22) Filed: Apr. 17, 2014

(65) Prior Publication Data

US 2015/0299601 A1 Oct. 22, 2015

(51) Int. Cl.

*C10M 137/10* (2006.01)
*C10M 141/10* (2006.01)
*C10M 129/08* (2006.01)

(52) U.S. Cl.

CPC ..... *C10M 141/10* (2013.01); *C10M 129/08* (2013.01); *C10M 137/10* (2013.01); *C10M 2207/022* (2013.01); *C10M 2223/045* (2013.01); *C10N 2220/028* (2013.01); *C10N 2230/06* (2013.01); *C10N 2230/54* (2013.01); *C10N 2230/56* (2013.01); *C10N 2240/10* (2013.01)

(58) Field of Classification Search

CPC . C10M 135/22; C10M 135/06; C10M 129/08
USPC ..... 508/370, 369
See application file for complete search history.

(56) References Cited

U.S. PATENT DOCUMENTS

| | | | |
|---|---|---|---|
| 3,185,647 | A | 5/1965 | Anderson et al. |
| 3,189,544 | A | 6/1965 | Hyman et al. |
| 3,256,185 | A | 6/1966 | Le Suer |
| 3,278,550 | A | 10/1966 | Norman et al. |
| 3,312,619 | A | 4/1967 | Dale |
| 3,366,569 | A | 1/1968 | Norman et al. |
| 3,390,086 | A | 6/1968 | Rosemary et al. |
| 3,403,102 | A | 9/1968 | Le Suer |
| 3,458,530 | A | 7/1969 | Siegel et al. |
| 3,470,098 | A | 9/1969 | O'Halloran |
| 3,502,677 | A | 3/1970 | Sner |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,708,552 | A | 1/1973 | Kunii et al. |
| 3,718,663 | A | 2/1973 | Lee et al. |
| 3,749,695 | A | 7/1973 | De Vries |
| 3,859,318 | A | 1/1975 | Le Suer |
| 3,865,740 | A | 2/1975 | Goldschmidt |
| 3,865,813 | A | 2/1975 | Gergel |
| 3,954,639 | A | 5/1976 | Liston |
| 4,152,499 | A | 5/1979 | Boerzel et al. |
| 4,234,435 | A | 11/1980 | Meinhardt et al. |
| 4,259,194 | A | 3/1981 | DeVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | DeVries et al. |
| 4,272,387 | A | 6/1981 | King et al. |
| 4,283,295 | A | 8/1981 | DeVries et al. |
| 4,285,822 | A | 8/1981 | DeVries et al. |
| 4,379,064 | A | 4/1983 | Cengel et al. |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,647,390 | A | 3/1987 | Buckley, III et al. |
| 4,648,886 | A | 3/1987 | Buckley, III et al. |
| 4,648,980 | A | 3/1987 | Erdman |
| 4,652,387 | A | 3/1987 | Andress, Jr. et al. |
| 4,663,062 | A | 5/1987 | Wollenberg |

(Continued)

FOREIGN PATENT DOCUMENTS

| | | | |
|---|---|---|---|
| GB | 1065595 | A1 | 4/1967 |
| GB | 2140811 | A1 | 12/1984 |
| WO | 2011007643 | A1 | 1/2011 |

OTHER PUBLICATIONS

Devlin, M. T., Lam, W. Y., McDonnell, T, F., "Critical Oil Physical Properties that Control the Fuel Economy Performance of General Motors Vehicles," SAE Technical Papers Series, No. 982503, SAE International, Oct. 19-22, 1998, pp. 1-6.

*Primary Examiner* — Prem C Singh
*Assistant Examiner* — Francis C Campanell
(74) *Attorney, Agent, or Firm* — Luedeka Neely Group, PC

(57) ABSTRACT

A lubricant additive, method for reducing a boundary friction coefficient of a lubricant composition, and method for improving fuel economy. The additive includes a synergistic mixture of a) a metal-containing phosphorus antiwear compound derived from at least one secondary alcohol in an amount sufficient to provide the lubricant composition with from about 200 to about 1000 ppm by weight phosphorus, and b) a polyol derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms. The polyol is present in the lubricant additive in an amount sufficient to provide a synergistic reduction in the boundary friction coefficient of the lubricant composition in combination with component (a).

12 Claims, No Drawings

(56) References Cited

U.S. PATENT DOCUMENTS

| | | | |
|---|---|---|---|
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,713,189 | A | 12/1987 | Nalesnik et al. |
| 4,713,191 | A | 12/1987 | Nalesnik |
| 4,857,214 | A | 8/1989 | Papay et al. |
| 4,948,386 | A | 8/1990 | Sung et al. |
| 4,963,275 | A | 10/1990 | Gutierrez et al. |
| 4,963,278 | A | 10/1990 | Blain et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman |
| 5,039,307 | A | 8/1991 | Herbstman et al. |
| 5,241,003 | A | 8/1993 | Degonia et al. |
| 5,321,172 | A | 6/1994 | Alexander et al. |
| 5,334,321 | A | 8/1994 | Harrison et al. |
| 5,650,381 | A | 7/1997 | Gatto et al. |
| 5,739,355 | A | 4/1998 | Gateau et al. |
| 5,883,057 | A | 3/1999 | Roell, Jr. et al. |
| RE37,363 | E | 9/2001 | Gatto et al. |
| 6,300,291 | B1 | 10/2001 | Hartley et al. |
| 6,723,685 | B2 | 4/2004 | Hartley et al. |
| RE38,929 | E | 1/2006 | Gatto et al. |
| 7,214,649 | B2 | 5/2007 | Loper et al. |
| RE40,595 | E | 12/2008 | Gatto et al. |
| 7,645,726 | B2 | 1/2010 | Loper |
| 7,897,696 | B2 | 3/2011 | Huang et al. |
| 8,048,831 | B2 | 11/2011 | Loper |
| 2002/0038525 | A1 | 4/2002 | Callis et al. |
| 2004/0087450 | A1* | 5/2004 | Boffa ..... C10M 163/00 508/185 |
| 2012/0101017 | A1 | 4/2012 | Duggal |
| 2012/0202723 | A1* | 8/2012 | Abbey ..... C07C 29/34 508/262 |

* cited by examiner

LUBRICANT ADDITIVES AND LUBRICANT COMPOSITIONS HAVING IMPROVED FRICTIONAL CHARACTERISTICS

TECHNICAL FIELD

The disclosure relates to lubricant additives and lubricant compositions that provide improved frictional characteristics for engine oil and gear applications. In particular, the disclosure relates to a unique combination of metal-containing phosphorus antiwear agents and polyols that provides synergistically improved boundary friction characteristics to a lubricant composition.

BACKGROUND AND SUMMARY

In recent years, there has been growing concern to produce energy-efficient lubricated components. Moreover, modern engine oil specifications require lubricants to demonstrate fuel efficiency in standardized engine tests. The thickness and frictional characteristics of lubricant films are known to affect the fuel economy properties of oils.

When rubbing surfaces in a machine (engine, gear system or transmission) come into contact, a frictional force exists that retards the motion of the surfaces. This frictional force, called boundary friction, reduces the efficiency of the machine. Boundary friction coefficients may be measured for a lubricant composition using the high frequency reciprocating rig (HFRR). The boundary friction measured in the HFRR is known to be related to fuel efficiency in vehicles. The ability of the lubricant composition to reduce boundary layer friction is reflected by the determined boundary lubrication regime coefficient of friction (COF). A lower value is indicative of lower friction and thus improved fuel economy.

The present disclosure relates to a lubricant additive, method for reducing a boundary friction coefficient of a lubricant composition, and method for improving fuel economy. The additive includes a synergistic mixture of a) a metal-containing phosphorus antiwear compound derived from at least one secondary alcohol in an amount sufficient to provide the lubricant composition with from about 200 to about 1000 ppm by weight phosphorus, and b) a polyol derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms. The polyol is present in the lubricant additive in an amount sufficient to provide a synergistic reduction in the boundary friction coefficient of the lubricant composition in combination with component (a).

Another embodiment of the disclosure provides a method for synergistically reducing a boundary friction coefficient of a lubricant composition. The method includes combining a base oil of lubricating viscosity having a first boundary friction coefficient with a lubricant additive containing a) a metal-containing phosphorus antiwear compound derived from at least one secondary alcohol in an amount sufficient to provide the lubricant composition with from about 200 to about 1000 ppm by weight phosphorus, and b) a polyol derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms. The polyol is present in the lubricant additive in combination with component (a) in an amount sufficient to provide a second boundary friction coefficient of the lubricant composition that is less than the first boundary friction coefficient of the lubricant composition.

Yet another embodiment of the disclosure provides a method for improving the fuel economy of a vehicle. The method includes lubricating the vehicle with a lubricant composition that includes a) a base oil of lubricating viscosity; b) a metal-containing phosphorus antiwear compound derived from at least one secondary alcohol in an amount sufficient to provide the lubricant composition with from about 200 to about 1000 ppm by weight phosphorus; and c) a polyol derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms. The polyol is present in the lubricant composition in combination with component (b) in an amount sufficient to provide a boundary friction coefficient of the lubricant composition that is synergistically less than a boundary friction coefficient of the lubricant composition containing only one of component (b) or component (c).

An unexpected advantage of the additive and methods described herein is that the boundary coefficient of friction is reduced by the combination of metal-containing phosphorus antiwear compound and polyol despite the fact that the same polyol may actually increase the boundary friction coefficient of the base oil in the absence of the metal-containing phosphorus antiwear compound. Additional the boundary coefficient of friction may also be lower than the boundary coefficient of friction provided by the metal-containing phosphorus antiwear compound in the absence of the polyol.

SUMMARY AND TERMS

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating composition excluding the major amount of base oil stock mixture. The additive package may or may not include the viscosity index improver or pour point depressant.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic moiety);

(b) substituted hydrocarbon substituents, that is, substituents containing non-hydrocarbon groups which, in the context of this disclosure, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain other than carbon in a ring or chain otherwise composed of carbon atoms. Heteroatoms may include sulfur, oxygen, and nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines, aviation piston engines, low-load diesel engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubricated coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The lubricant composition for an internal combustion engine may be suitable for any engine lubricant irrespective of the sulfur, phosphorus, or sulfated ash (ASTM D-874) content. The sulfur content of the engine oil lubricant may be about 1 wt % or less, or about 0.8 wt % or less, or about 0.5 wt % or less, or about 0.3 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

In one embodiment the lubricating composition is an engine oil, wherein the lubricating composition may have (i) a sulfur content of about 0.5 wt % or less, (ii) a phosphorus content of about 0.1 wt % or less, and (iii) a sulfated ash content of about 1.5 wt % or less.

In one embodiment the lubricating composition is suitable for a 2-stroke or a 4-stroke marine diesel internal combustion engine. In one embodiment the marine diesel combustion engine is a 2-stroke engine.

Further, lubricants of the present description may be suitable to meet one or more industry specification requirements such as ILSAC GF-3, GF-4, GF-5, GF-6, PC-11, CI-4, CJ-4, ACEA A1/B1, A2/B2, A3/B3, A5/B5, C1, C2, C3, C4, E4/E6/E7/E9, Euro 5/6, Jaso DL-1, Low SAPS, Mid SAPS, or original equipment manufacturer specifications such as Dexos™ 1, Dexos™ 2, MB-Approval 229.51/229.31, VW 502.00, 503.00/503.01, 504.00, 505.00, 506.00/506.01, 507.00, BMW Longlife-04, Porsche C30, Peugeot Citroen Automobiles B71 2290, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

The present disclosure provides novel lubricating oil blends specifically formulated for use as automotive crankcase lubricants. Embodiments of the present disclosure may provide lubricating oils suitable for crankcase applications and having improvements in the following characteristics: air entrainment, alcohol fuel compatibility, antioxidancy, antiwear performance, biofuel compatibility, foam reducing properties, friction reduction, fuel economy, preignition prevention, rust inhibition, sludge and/or soot dispersability, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil. The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Metal-Containing Phosphorus Antiwear Component

As set forth above, the present disclosure relates to a lubricant additive, method for reducing a boundary friction coefficient of a lubricant composition, and method for improving fuel economy. An important component of the additive and methods described herein is a metal-containing phosphorus antiwear compound derived from at least one secondary alcohol. Such antiwear agents typically comprise dihydrocarbyl dithiophosphate metal salts wherein the metal may be an alkali or alkaline earth metal, or aluminum, lead, tin, molybdenum, manganese, nickel, copper, titanium, or zinc. The zinc salts are most commonly used in lubricating oils.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting primary, secondary, or mixtures of primary and secondary alcohols with $P_2S_5$. To make the metal salt, any basic or neutral metal compound may be used but the oxides, hydroxides and carbonates are most generally used. Commercial additives frequently contain an excess of metal due to the use of an excess of the basic metal compound in the neutralization reaction.

The zinc dihydrocarbyl dithiophosphates (ZDDP) that are typically used are oil soluble salts of dihydrocarbyl dithiophosphoric acids and may be represented by the following formula:

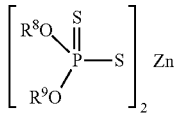

wherein $R^8$ and $R^9$ may be the same or different hydrocarbyl radicals containing from 1 to 18, typically 2 to 12, carbon atoms and including radicals such as alkyl, alkenyl, aryl, arylalkyl, alkaryl and cycloaliphatic radicals. Particularly desired as $R^8$ and $R^9$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R^8$ and $R^9$) in the dithiophosphoric acid will generally be about 5 or greater. The zinc dihydrocarbyl dithiophosphate may therefore comprise zinc dialkyl dithiophosphates.

In order to limit the amount of phosphorus introduced into the lubricating oil composition by ZDDP to no more than 0.1 wt. % (1000 ppm), the ZDDP should desirably be added to the lubricating oil compositions in amounts no greater than from about 1.1 to 1.3 wt. %, based upon the total weight of the lubricating oil composition. For example, the phosphorus-based antiwear agent may be present in a lubricating composition in an amount sufficient to provide from about 200 to about 1000 ppm by weight phosphorus based on a total weight of the lubricant composition. As a further example, the phosphorus-based antiwear agent may be present in a lubricating composition in an amount sufficient to provide from about 400 to about 800 ppm by weight phosphorus to a fully formulated lubricant composition.

According to embodiments of the disclosure, the metal-containing phosphorus antiwear compound may include compounds made from primary alcohols and compounds made from secondary alcohols or compounds made from a combination of primary and secondary alcohols. In other words, the metal-containing phosphorus antiwear component includes at least one compound containing moieties derived from a secondary alcohol. Hence, the metal-containing phosphorous component may include a mixture of (i) a metal-containing phosphorus antiwear compound derived from primary alcohols and (ii) a metal-containing phosphorus antiwear compound derived from secondary alcohols, wherein a weight ratio of (i) to (ii) based on ppm by weight phosphorus provided by (i) and (ii) to the lubricant composition ranges from 0:1 to about 4:1, such as from about 0.25:1 to about 3:1, or from about 0.5:1 to about 2:1, or 1:1.

In another embodiment, the metal-containing phosphorus antiwear component may be derived from a mixture of primary and secondary alcohols such that a molar ratio of primary alcohols to secondary alcohols in the component ranges from about 0.25:1 to about 4:1.

Polyol Component

Another important component of the additive and methods described herein is a polyol as generally disclosed in U.S. Patent Publication No. 2012/0202723, the disclosure of which is incorporated herein by reference. The polyol is derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms.

Exemplary polyols that may be used, include, but are not limited to polyols derived from a linear or branched alkyl diol having 10 carbon atoms reacted with a linear or branched alkyl mono-ol having 12 carbon atoms with a diol to mono-ol molar ratio of 0.3:1; a linear or branched alkyl diol having 36 carbon atoms reacted with a linear or branched alkyl mono-ol having 16 carbon atoms with a diol to mono-ol molar ratio of 0.3:1; a linear or branched alkyl diol having 10 carbon atoms reacted with a linear or branched alkyl mono-ol having 16 carbon atoms with a diol to mono-ol molar ratio of 1:1; a linear or branched alkyl diol having 10 carbon atoms reacted with a linear or branched alkyl mono-ol having 16 carbon atoms with a diol to mono-ol molar ratio of 2:1; a mixture of (i) a linear or branched alkyl diol having 6 carbon atoms and (ii) a linear or branched alkyl diol having 10 carbon atoms reacted with a linear or branched alkyl mono-ol having 16 carbon atoms with a diol to mono-ol molar ratio of 1:1; a mixture of (i) a linear or branched alkyl diol having 6 carbon atoms and (ii) a linear or branched alkyl diol having 10 carbon atoms reacted with a linear or branched alkyl mono-ol having 16 carbon atoms with a diol to mono-ol molar ratio of 2:1; a mixture of (i) a linear or branched alkyl diol having 36 carbon atoms and (ii) a linear or branched alkyl diol having 10 carbon atoms reacted with a linear or branched alkyl mono-ol having 16 carbon atoms with a diol to mono-ol molar ratio of 1:1; and a mixture of (i) a linear or branched alkyl diol having 36 carbon atoms and (ii) a linear or branched alkyl diol having 10 carbon atoms reacted with a linear or branched alkyl mono-ol having 16 carbon atoms with a diol to mono-ol molar ratio of 2:1. Other polyols described in U.S. Patent Publication No. 2012/0202723 may be suitable for providing a similar synergistic reduction in the boundary coefficient of friction in combination with the metal-containing phosphorus antiwear component described above.

The polyol is present in the lubricant additive in an amount sufficient to provide a synergistic reduction in the boundary friction coefficient of the lubricant composition in combination with the metal-containing phosphorus antiwear component. Accordingly, the polyol component may be present in a lubricant composition in an amount ranging from about 0.2 to 2.0 weight percent based on a total weight of the lubricant composition.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricant compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the oil of lubricating viscosity present may be the balance remaining after subtracting from 100 wt % the sum of the foregoing additive components in combination with other performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., IRGANOX™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include ETHANOX™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the lubricating composition.

Auxiliary Antiwear Agents

The lubricating oil compositions herein may also optionally contain one or more auxiliary antiwear agents. Examples of suitable auxiliary antiwear agents include, but are not limited to, a metal thiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. The phosphorus containing antiwear agents are more fully described in European Patent 612 839.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The auxiliary antiwear agent may be present in ranges including about 0 wt % to about 10 wt %, or about 0.01 wt % to about 5 wt %, or about 0.05 wt % to about 2 wt %, or about 0.1 wt % to about 1 wt % of the lubricating composition.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating composition.

Detergents

The lubricant composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The detergent may be present at about 0 wt % to about 10 wt %, or about 0.1 wt % to about 8 wt %, or about 1 wt % to about 4 wt %, or greater than about 4 wt % to about 8 wt %.

Dispersants

The lubricant composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range about 350 to about 50,000, or to about 5,000, or to about 3,000. Succinimide dispersants and their preparation are disclosed, for instance in U.S. Pat. No. 7,897,696 or U.S. Pat. No. 4,234,435. The polyolefin may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

In an embodiment the present disclosure further comprises at least one polyisobutylene succinimide dispersant derived from polyisobutylene with number average molecular weight in the range about 350 to about 50,000, or to about 5000, or to about 3000. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000 is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights.

In one embodiment, the dispersant may be derived from a polyalphaolefin (PAO) succinic anhydride.

In one embodiment, the dispersant may be derived from olefin maleic anhydride copolymer. As an example, the dispersant may be described as a poly-PIBSA.

In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. No. 7,645,726; U.S. Pat. No. 7,214,649; and U.S. Pat. No. 8,048,831 are incorporated herein by reference.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or ditholactone (e.g., U.S. Pat. Nos. 4,614,603 and 4,666,460); Cyclic carbonate or thiocarbonate, linear monocarbonate or plycarbonate, or chloroformate (e.g., U.S. Pat. Nos. 4,612,132; 4,647,390; 4,646,860; and 4,670,170); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711).

The TBN of a suitable dispersant may be from about 10 to about 65 on an oil-free basis, which is comparable to about 5 to about 30 TBN if measured on a dispersant sample containing about 50% diluent oil.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, or about 3 wt % to about 10 wt %, or about 1 wt % to about 6 wt %, or about 7 wt % to about 12 wt %, based upon the final weight of the lubricating oil composition. In one embodiment, the lubricating oil composition utilizes a mixed dispersant system.

Extreme Pressure Agents

The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl)disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a diester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference.

A friction modifier may optionally be present in ranges such as about 0 wt % to about 10 wt %, or about 0.01 wt % to about 8 wt %, or about 0.1 wt % to about 4 wt %.

Molybdenum-Containing Component

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; U.S. Pat. No. RE 37,363 E1; U.S. Pat. No. RE 38,929 E1; and U.S. Pat. No. RE 40,595 E1, incorporated herein by reference.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOC_{14}$, $MoO_2Br_2$, $Mo_2O_3C_{16}$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Another class of suitable organo-molybdenum compounds are trinuclear molybdenum compounds, such as those of the formula $Mo_3SkL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Titanium-Containing Compounds

Another class of additives includes oil-soluble titanium compounds. The oil-soluble titanium compounds may function as antiwear agents, friction modifiers, antioxidants, deposit control additives, or more than one of these functions. In an embodiment the oil soluble titanium compound may be a titanium (IV) alkoxide. The titanium alkoxide may be formed from a monohydric alcohol, a polyol, or mixtures thereof. The monohydric alkoxides may have 2 to 16, or 3 to 10 carbon atoms. In an embodiment, the titanium alkoxide may be titanium (IV) isopropoxide. In an embodiment, the titanium alkoxide may be titanium (IV) 2-ethylhexoxide. In an embodiment, the titanium compound may be the alkoxide of a 1,2-diol or polyol. In an embodiment, the 1,2-diol comprises a fatty acid mono-ester of glycerol, such as oleic acid. In an embodiment, the oil soluble titanium compound may be a titanium carboxylate. In an embodiment the titanium (IV) carboxylate may be a reaction product of titanium isopropoxide and neodecanoic acid.

In an embodiment the oil soluble titanium compound may be present in the lubricating composition in an amount to provide from zero to about 1500 ppm titanium by weight or about 10 ppm to 500 ppm titanium by weight or about 25 ppm to about 150 ppm.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating composition.

Other Optional Additives

Other additives may be selected to perform one or more functions required of a lubricating fluid. Further, one or more of the mentioned additives may be multi-functional and provide functions in addition to or other than the function prescribed herein.

A lubricating composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, lubricant compositions suitable for crankcase and gear applications may include combinations of additive components in the ranges listed in the following table.

TABLE 2

| Component | Wt. % (Suitable Embodiments) | Wt. % (Suitable Embodiments) |
|---|---|---|
| Dispersant(s) | 0.1-10.0 | 1.0-5.0 |
| Antioxidant(s) | 0.1-5.0 | 0.01-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-20.0 | 0.25-10.0 |
| Friction modifier(s) | 0.01-5.0 | 0.05-2.0 |
| Polyols | 0.01-5.0 | 0.1-3.0 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the disclosure. All patents and publications cited herein are fully incorporated by reference herein in their entirety.

In the following examples the boundary coefficients of friction were determined using HFRR test conditions as described in SAE paper 982503. The compositions included base oil, ZDDP, and/or polyol only and were not fully formulated lubricant compositions. The HFRR friction coefficients were measured at 130° C. The polyols used in the examples were from Lord Corporation of Cary, N.C.

The following metal-containing phosphorus antiwear compounds were used in the examples:

ZDDP-1 was zinc dialkyldithiophosphate derived from all primary alcohols having 8 carbon atoms.

ZDDP-2 was zinc dialkyldithiophosphate derived from a mixture of 60 mole % primary alcohols and 40 mol % secondary alcohols.

ZDDP-3 was zinc dialkyldithiophosphate derived from a mixture of secondary alcohols having 3 carbon atoms and secondary alcohols having 6 carbon atoms.

ZDDP-4 was zinc dialkyldithiophosphate derived from all secondary alcohols having 6 carbon atoms.

ZDDP-5 was a mixture of ZDDP-1 and ZDDP-3 in a 1:3 weight ratio based on phosphorus content of the lubricant composition.

ZDDP-6 was a mixture of ZDDP-1 and ZDDP-3 in a 1:1 weight ratio based on phosphorus content of the lubricant composition.

ZDDP-7 was a mixture of ZDDP-1 and ZDDP-3 in a 3:1 weight ratio based on phosphorus content of the lubricant composition.

The following polyols were used in the examples:

Polyol-1 was derived from a 10 carbon atom diol reacted with a 12 carbon atom mono-ol having a diol to mono-ol molar ratio of 0.3:1.

Polyol-2 was derived from a 36 carbon atom diol reacted with a linear 16 carbon atom mono-ol having a diol to mono-ol molar ratio of 0.3:1.

Polyol-3 was derived from a 36 carbon atom diol reacted with a branched 16 carbon atom mono-ol having a diol to mono-ol molar ratio of 0.3:1.

Polyol-4 was derived from a branched 10 carbon atom diol reacted with a branched 16 carbon atom mono-ol having a diol to mono-ol molar ratio of 0.3:1.

Polyol-5 was derived from a 10 carbon atom diol reacted with a 16 carbon atom mono-ol having a diol to mono-ol molar ratio of 1.0:1.

Polyol-6 was derived from a 10 carbon atom diol reacted with a 16 carbon atom mono-ol having a diol to mono-ol molar ratio of 2.0:1.

Polyol-7 was derived from a mixture of a 6 carbon atom diol and a 10 carbon atom diol reacted with a 16 carbon atom mono-ol having a diol to mono-ol molar ratio of 1.0:1.

Polyol-8 was derived from a mixture of a 6 carbon atom diol and a 10 carbon atom diol reacted with a 16 carbon atom mono-ol having a diol to mono-ol molar ratio of 2.0:1.

Polyol-9 was derived from a mixture of a 36 carbon atom diol and a 10 carbon atom diol reacted with a 16 carbon atom mono-ol having a diol to mono-ol molar ratio of 1.0:1.

Polyol-10 was derived from a mixture of a 36 carbon atom diol and a 10 carbon atom diol reacted with a 16 carbon atom mono-ol having a diol to mono-ol molar ratio of 2.0:1.

Boundary coefficients of friction for various combinations of the foregoing components at 200 ppm by weight and 800 ppm by weight phosphorus based on a total weight of the lubricant composition are shown in the following table. The base oil used for all of the friction tests was a Group II base oil.

TABLE 3

| Ex. | ZDDP | Total ppm by wt. Phosphorus | Polyol | Polyol wt. % | HFRR at 130° C. Coefficient of Friction | % Reduction vs. base oil alone | Incr. % Red. |
|---|---|---|---|---|---|---|---|
| 1 | — | — | — | — | 0.196 | — | |
| 2 | ZDDP-1 | 200 | — | — | 0.142 | 27 | −10 |
| 3 | ZDDP-1 | 200 | Polyol-1 | 0.5 | 0.162 | 17 | |
| 4 | ZDDP-1 | 800 | — | — | 0.137 | 30 | −1 |
| 5 | ZDDP-1 | 800 | Polyol-1 | 0.5 | 0.139 | 29 | |
| 6 | ZDDP-2 | 200 | — | — | 0.139 | 29 | 4 |
| 7 | ZDDP-2 | 200 | Polyol-1 | 0.5 | 0.131 | 33 | |
| 8 | ZDDP-2 | 800 | — | — | 0.151 | 23 | 11 |
| 9 | ZDDP-2 | 800 | Polyol-1 | 0.5 | 0.129 | 34 | |
| 10 | ZDDP-3 | 200 | — | — | 0.160 | 18 | 17 |
| 11 | ZDDP-3 | 200 | Polyol-1 | 0.5 | 0.128 | 35 | |
| 12 | ZDDP-3 | 800 | — | — | 0.181 | 8 | 29 |
| 13 | ZDDP-3 | 800 | Polyol-1 | 0.5 | 0.124 | 37 | |

TABLE 3-continued

| Ex. | ZDDP | Total ppm by wt. Phosphorus | Polyol | Polyol wt. % | HFRR at 130° C. Coefficient of Friction | % Reduction vs. base oil alone | Incr. % Red. |
|---|---|---|---|---|---|---|---|
| 14 | ZDDP-4 | 200 | — | — | 0.170 | 13 | 20 |
| 15 | ZDDP-4 | 200 | Polyol-1 | 0.5 | 0.132 | 33 | |
| 16 | ZDDP-4 | 800 | — | — | 0.184 | 6 | 31 |
| 17 | ZDDP-4 | 800 | Polyol-1 | 0.5 | 0.123 | 37 | |
| 18 | ZDDP-5 | 800 | — | — | 0.142 | 28 | 9 |
| 19 | ZDDP-5 | 800 | Polyol-1 | 0.5 | 0.124 | 37 | |
| 20 | ZDDP-6 | 800 | — | — | 0.140 | 29 | 7 |
| 21 | ZDDP-6 | 800 | Polyol-1 | 0.5 | 0.126 | 36 | |
| 22 | ZDDP-7 | 800 | — | — | 0.137 | 30 | 5 |
| 23 | ZDDP-7 | 800 | Polyol-1 | 0.5 | 0.128 | 35 | |
| 24 | ZDDP-1 | 610 | — | — | 0.140 | 29 | |
| 25 | ZDDP-1 | 610 | Polyol-1 | 0.5 | 0.140 | 29 | |
| 26 | ZDDP-1 | 610 | Polyol-2 | 0.5 | 0.142 | 28 | |
| 27 | ZDDP-1 | 610 | Polyol-3 | 0.5 | 0.148 | 24 | |
| 28 | ZDDP-1 | 610 | Polyol-4 | 0.5 | 0.148 | 24 | |
| 29 | ZDDP-2 | 835 | — | — | 0.143 | 27 | |
| 30 | ZDDP-2 | 835 | Polyol-1 | 0.5 | 0.128 | 35 | |
| 31 | ZDDP-2 | 835 | Polyol-2 | 0.5 | 0.132 | 33 | |
| 32 | ZDDP-2 | 835 | Polyol-3 | 0.5 | 0.137 | 30 | |
| 33 | ZDDP-2 | 835 | Polyol-4 | 0.5 | 0.134 | 32 | |
| 34 | ZDDP-3 | 820 | — | — | 0.165 | 16 | |
| 35 | ZDDP-3 | 820 | Polyol-1 | 0.5 | 0.127 | 35 | |
| 36 | ZDDP-3 | 820 | Polyol-2 | 0.5 | 0.146 | 26 | |
| 37 | ZDDP-3 | 820 | Polyol-3 | 0.5 | 0.132 | 33 | |
| 38 | ZDDP-3 | 820 | Polyol-4 | 0.5 | 0.128 | 35 | |
| 39 | ZDDP-5 | 715 | — | — | 0.142 | 28 | |
| 40 | ZDDP-5 | 715 | Polyol-1 | 0.5 | 0.132 | 33 | |
| 41 | ZDDP-5 | 715 | Polyol-2 | 0.5 | 0.128 | 35 | |
| 42 | ZDDP-5 | 715 | Polyol-3 | 0.5 | 0.133 | 32 | |
| 43 | ZDDP-5 | 715 | Polyol-4 | 0.5 | 0.129 | 34 | |
| 44 | — | — | Polyol-5 | 0.2 | 0.247 | −26 | 59 |
| 45 | ZDDP-3 | 820 | Polyol-5 | 0.2 | 0.132 | 33 | |
| 46 | — | — | Polyol-5 | 1.0 | 0.233 | −19 | 59 |
| 47 | ZDDP-3 | 820 | Polyol-5 | 1.0 | 0.118 | 40 | |
| 48 | — | — | Polyol-6 | 0.2 | 0.234 | −19 | 48 |
| 49 | ZDDP-3 | 820 | Polyol-6 | 0.2 | 0.140 | 29 | |
| 50 | — | — | Poloyl-6 | 1.0 | 0.241 | −23 | 61 |
| 51 | ZDDP-3 | 820 | Poloyl-6 | 1.0 | 0.122 | 38 | |
| 52 | — | — | Polyol-7 | 0.2 | 0.206 | −5 | 38 |
| 53 | ZDDP-3 | 820 | Polyol-7 | 0.2 | 0.132 | 33 | |
| 54 | — | — | Polyol-7 | 1.0 | 0.186 | 5 | 43 |
| 55 | ZDDP-3 | 820 | Polyol-7 | 1.0 | 0.122 | 38 | |
| 56 | — | — | Polyol-8 | 0.2 | 0.232 | −18 | 47 |
| 57 | ZDDP-3 | 820 | Polyol-8 | 0.2 | 0.140 | 29 | |
| 58 | — | — | Poloyl-8 | 1.0 | 0.247 | −26 | 64 |
| 59 | ZDDP-3 | 820 | Poloyl-8 | 1.0 | 0.122 | 38 | |
| 60 | — | — | Polyol-9 | 0.2 | 0.208 | −6 | 39 |
| 61 | ZDDP-3 | 820 | Polyol-9 | 0.2 | 0.132 | 33 | |
| 62 | — | — | Polyol-9 | 1.0 | 0.220 | −12 | 48 |
| 63 | ZDDP-3 | 820 | Polyol-9 | 1.0 | 0.125 | 36 | |
| 64 | — | — | Polyol-10 | 0.2 | 0.230 | −17 | 49 |
| 65 | ZDDP-3 | 820 | Polyol-10 | 0.2 | 0.133 | 32 | |
| 66 | — | — | Poloyl-10 | 1.0 | 0.214 | −9 | 45 |
| 67 | ZDDP-3 | 820 | Poloyl-10 | 1.0 | 0.125 | 36 | |

Example 1 containing only base oil, and had a coefficient of friction of 0.196. Using Example 1 as a baseline, Examples 2, 4, 6, 8, 10, 12, 14, 16, and 39 (which contained base oil and each of ZDDPs 1-5 at phosphorus levels ranging from 200 to 835 ppm) showed a reduction in the HFRR coefficient of friction of 6 to 30 percent.

Also using Example 1 as a baseline, Examples 44, 46, 48, 50, 52, 56, 58, 60, 62, 64 and 66 (which contained base oil and Polyols 5-10 at concentrations ranging from 0.2 to 1.0 wt. %) showed an increase in the HFRR coefficient of friction of 5 to 26 percent. Example 54 showed a slight decrease in coefficient of friction at 1.0 wt. % of Polyol 7.

Examples 2-5 and 24-28, with or without polyol had a % reduction in coefficient of friction ranging from 17 to 30 percent when the ZDDP-1 made from all primary alcohols was used. Examples 1-4 showed that there was actually a decrease in the % reduction of the HFRR coefficient of friction when ZDDP-1 was combined with Polyol-1 at 0.5 wt. % and at 200 and 800 ppm by weight total phosphorus in the lubricant composition compared to the same ZDDP-1 in the absence of Polyol-1. By comparison, Polyol-1 at 0.5 wt. % combined with ZDDP-2, ZDDP-3, or ZDDP-4 at 200 and 800 ppm by weight total phosphorous had an increase in the % reduction of the HFRR coefficient of friction as shown by Examples 6-17 compared to the same ZDDP's in the absence of the polyol component.

All of the ZDDP's 2, 3 and 5 in the presence of Polyols 1-4 showed a significant increase in % reduction of the HFRR coefficient of friction compared to the same ZDDP's in the absence of the polyols as shown by Examples 30-33 compared to Example 29, Examples 35-38 compared to Example 34, and Examples 40-43 compared to Example 39.

Examples 19, 21, and 23 containing a mixture primary and secondary ZDDP's (ZDDP's 5, 6, and 7) at a ratio of 1:3 to 3:1 showed a beneficial reduction on the HFRR coefficient of friction in the presence of polyol similar to the reduction in HFRR coefficient of friction achieved by ZDDP-2 in the presence of polyol.

Further, Examples 45, 47, 49, 51, 53, 55, 57, 59, 61, 63, 65, and 67 containing ZDDP-3 at 820 ppm total phosphorus showed significant improvements in % reduction of the HFRR coefficient of friction when combined with Polyols 7-10 at treat rates of polyol of 0.2 to 1.0 wt. % of the total weight of the lubricant composition compared to Examples 44, 46, 48, 50, 52, 54, 56, 58, 60, 62, 64, and 66 for Polyols 5-10 alone. The foregoing examples showed there was a synergistic increase in the % reduction of the HFRR coefficient of friction compared to the examples containing only one of the ZDDP or Polyol component.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricant additive for reducing a boundary friction coefficient of a lubricant composition, comprising a synergistic mixture comprising:

a) a zinc dihydrocarbyl dithiophosphate antiwear compound derived from at least one secondary alcohol in an amount sufficient to provide the lubricant composition with from about 200 to about 835 ppm by weight phosphorus based on a total weight of the lubricant composition, wherein each hydrocarbyl group contains from 2 to 8 carbon atoms, wherein component (a) comprises a mixture of (i) a zinc dihydrocarbyl dithiophosphate antiwear compound derived from primary alcohols and (ii) a zinc dihydrocarbyl dithiophosphate antiwear compound derived from secondary alcohols, wherein a weight ratio of (i) to (ii) based on ppm by weight phosphorus provided by (i) and (ii) to the lubricant composition ranges from 0:1 to about 3:1, and b) a polyol derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms, wherein the polyol in combination with component (a) provide a synergistic reduction in the boundary friction coefficient of the lubricant composition, wherein the polyol is present in an amount ranging from about 0.2 to about 1.0 wt. % based on the total weight of the lubricant composition.

2. The lubricant additive of claim 1, wherein the amount of polyol ranges from about 0.5 to about 1.0 wt. % based on the total weight of the lubricant composition.

3. The lubricant additive of claim 1, wherein component (a) is present in an amount to provide from about 400 to about 800 ppm by weight phosphorus based on the total weight of the lubricant composition.

4. A lubricant composition comprising a base oil and from about 2 wt. % to about 12 wt. % of the lubricant additive of claim 1.

5. A method for synergistically reducing a boundary friction coefficient of a lubricant composition, comprising combining a base oil of lubricating viscosity having a first boundary friction coefficient with a lubricant additive comprising:

a) a zinc dihydrocarbyl dithiophosphate antiwear compound derived from at least one secondary alcohol in an amount sufficient to provide the lubricant composition with from about 200 to about 835 ppm by weight phosphorus based on a total weight of the lubricant composition, wherein each hydrocarbyl group contains from 2 to 8 carbon atoms, wherein component (a) comprises a mixture of (i) a zinc dihydrocarbyl dithiophosphate antiwear compound derived from primary alcohols and (ii) a zinc dihydrocarbyl dithiophosphate antiwear compound derived from secondary alcohols, wherein a weight ratio of (i) to (ii) based on ppm by weight phosphorus provided by (i) and (ii) to the lubricant composition ranges from 0:1 to about 3:1; and b) a polyol derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms, wherein the polyol in combination with component (a) provide a second boundary friction coefficient of the lubricant composition that is less than the first boundary friction coefficient of the lubricant composition, wherein the lubricant composition comprises from about 0.2 to about 1.0 wt. % of component (b) based on the total weight of the lubricant composition.

6. The method of claim 5, wherein the second boundary friction coefficient is less than a third boundary friction coefficient of the base oil and component (a) in the absence of component (b).

7. The method of claim 5, wherein a fourth boundary friction coefficient of component (b) and the base oil in the absence of component (a) is greater than first boundary friction coefficient, the second boundary friction coefficient, and the third boundary friction coefficient.

8. The method of claim 5, wherein the lubricant composition comprises from about 0.5 to about 1.0 wt. % of component (b) based on the total weight of the lubricant composition.

9. The method of claim 5, wherein component (a) is present in an amount to provide from about 400 to about 800 ppm by weight phosphorus based on the total weight of the lubricant composition.

10. A method for improving the fuel economy of a vehicle comprising lubricating the vehicle with a lubricant composition comprising:

a) a base oil of lubricating viscosity;

b) a zinc dihydrocarbyl dithiophosphate antiwear compound derived from at least one secondary alcohol in an amount sufficient to provide the lubricant composition with from about 200 to about 835 ppm by weight phosphorus based on a total weight of the lubricant composition, wherein each hydrocarbyl group contains from 2 to 8 carbon atoms, wherein component (a) comprises a mixture of (i) a zinc dihydrocarbyl dithiophosphate antiwear compound derived from primary alcohols and (ii) a zinc dihydrocarbyl dithiophosphate antiwear compound derived from secondary alcohols, wherein a weight ratio of (i) to (ii) based on ppm by weight phosphorus provided by (i) and (ii) to the lubricant composition ranges from 0:1 to about 3:1; and c) a polyol derived from a diol and a mono-ol having a diol to mono-ol molar ratio ranging from about 0.3:1 to about 2.0:1, wherein the diol contains from 6 to 36 carbon atoms and the mono-ol contains from 12 to 16 carbon atoms, wherein the polyol in combination with component (b) provide a boundary friction coefficient of the lubricant composition that is synergistically less than a boundary friction coefficient of the lubricant composition containing only one of component (b) or component (c), wherein the lubricant composition comprises from about 0.2 to about 1.0 wt. % of component (c) based on the total weight of the lubricant composition.

11. The method of claim 10, wherein the lubricant composition comprises from about 0.5 to about 1.0 wt. % of component (c) based on the total weight of the lubricant composition.

12. The method of claim 10, wherein the component (b) is present in an amount to provide from about 400 to about 800 ppm by weight phosphorus based on the total weight of the lubricant composition.

* * * * *